US005733238A

United States Patent [19]

Carr

[11] Patent Number: 5,733,238

[45] Date of Patent: Mar. 31, 1998

[54] SCRAPING ASSEMBLY HAVING ANGULARLY OFFSET SCRAPER BLADES FOR REMOVING SOLIDS FROM AN IMPERFORATE BOWL CENTRIFUGE

[75] Inventor: Robert B. Carr, Brookline, Mass.

[73] Assignee: Carr Separations, Inc., Franklin, Mass.

[21] Appl. No.: 547,475

[22] Filed: Oct. 24, 1995

[51] Int. Cl.[6] ..... B04B 11/08

[52] U.S. Cl. ..... 494/58; 210/375

[58] Field of Search ..... 494/56–59; 210/372–376

[56] References Cited

U.S. PATENT DOCUMENTS

| | | | |
|---|---|---|---|
| 689,571 | 12/1901 | Berrigan . | |
| 717,802 | 1/1903 | Berrigan . | |
| 1,286,626 | 12/1918 | Herr | 210/375 X |
| 1,542,747 | 6/1925 | Verney . | |
| 1,866,499 | 7/1932 | Herr | 210/375 X |
| 2,056,890 | 10/1936 | Pecker | 210/375 |
| 2,056,891 | 10/1936 | Pecker | 210/375 |
| 2,078,273 | 4/1937 | Pecker | 210/375 |
| 4,648,864 | 3/1987 | Evans et al. | 494/37 |
| 4,652,254 | 3/1987 | Matsumoto | 494/58 |
| 5,328,441 | 7/1994 | Carr | 494/58 |
| 5,425,698 | 6/1995 | Carr | 494/46 |

*Primary Examiner*—Charles E. Cooley
*Attorney, Agent, or Firm*—Darby & Darby

[57] ABSTRACT

A scraper assembly for removing the collected solids component of a feed material from an interior wall surface of a centrifugal separator bowl comprises a supporting shaft positioned within the bowl along a vertically disposed longitudinal axis. The supporting shaft is pivotal between a stowed position and an operational position. At least two longitudinally spaced scraper blades are attached to the supporting shaft along the longitudinal axis and are adapted to contact the solids component when the support shaft is in the operational position. An upper scraper blade is angularly offset with respect to the lower scraper blade along the longitudinal axis so that any collected solids component removed by the upper scraper blade may freely drop clear of the lower scraper blade.

2 Claims, 4 Drawing Sheets

Fig. 2
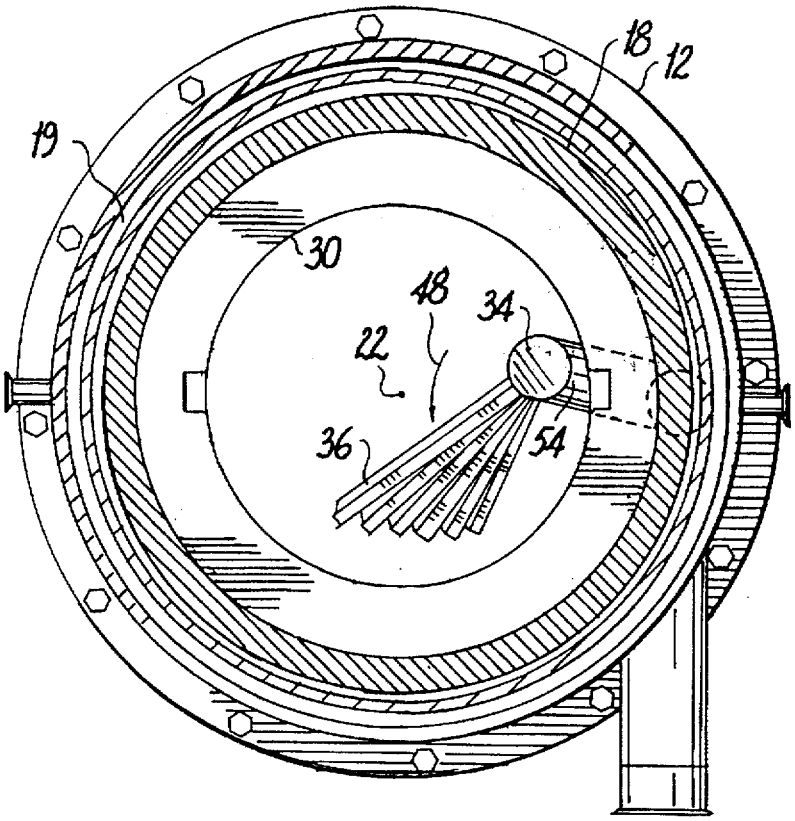
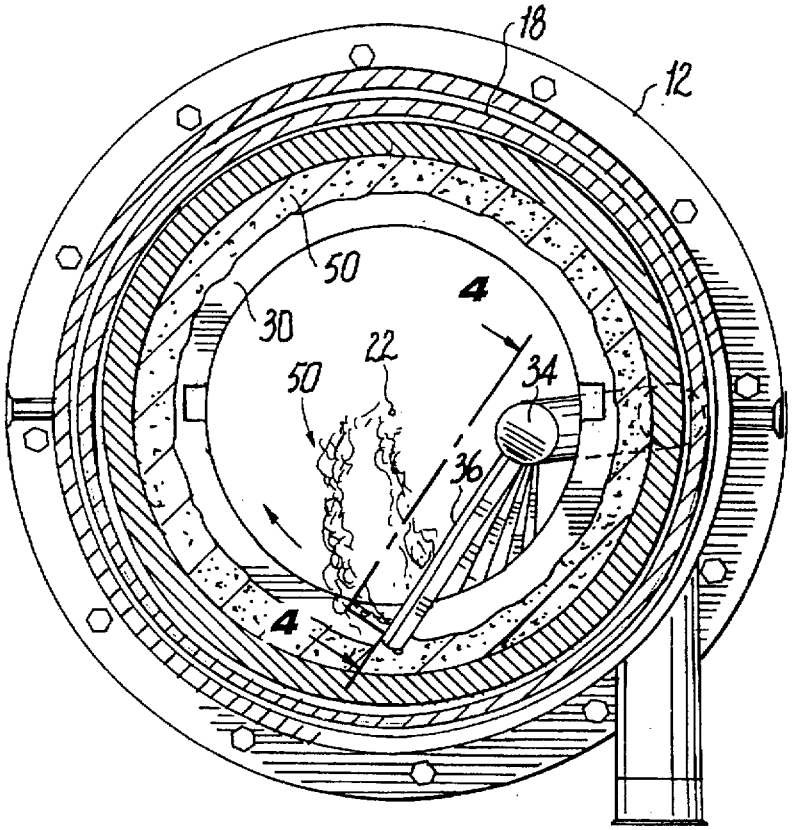
Fig. 3

SCRAPING ASSEMBLY HAVING ANGULARLY OFFSET SCRAPER BLADES FOR REMOVING SOLIDS FROM AN IMPERFORATE BOWL CENTRIFUGE

FIELD OF THE INVENTION

This invention relates to a scraper assembly for an imperforate bowl centrifuge, and more particularly to such a scraper assembly for removing sticky solids from the scraper.

BACKGROUND OF THE INVENTION

There are many different types of centrifugal separators and centrifuges adapted to separate a variety of heterogeneous mixtures into their respective components of different specific gravities. An imperforate bowl centrifugal separator is particularly suited to separate the different components of a hazardous material such as a biological material, and/or a material undergoing a procedure wherein outside contamination is undesirable. To ensure that a particular material of interest remains pure, and that no such material contaminates the external environment, the entire internal separating structure of these imperforate bowl separators is sealed from the environment and the entire separating cycle is performed, typically automatically, without providing external access to the separating structure within the separator.

During a feed mode of a typical separating cycle, a sample subject stock material, such as a liquid suspension (also called feed material or liquid feed) is injected through appropriate conduits and into a rotatable separating bowl of the separator. As the bowl rotates at speed sufficient to produce up to 20,000 G's (gravities), the suspended particles of the sample separate from the liquid centrate and form a "solids cake" against the wall of the bowl. The liquid suspension is continuously injected into the bowl as the bowl rotates and a clarified liquid (i.e., a liquid without a solids component) is continuously drawn from the bowl. The flow of liquid suspension through the bowl continues until sufficient solids have been collected against the inside walls of the bowl and must be removed during a drain and discharge mode. It is not uncommon for hundreds of gallons of liquid suspension to pass through the bowl prior to collecting a sufficient amount of solids against the wall to warrant performing the discharge mode.

Liquid is then removed from the bowl during a drain mode of the separation cycle. Depending on the initial sample being separated, the resulting solids forced against the wall of the bowl may have a very sticky consistency, similar to the consistency of peanut butter. Depending on the type of separator, the liquid centrate is removed from the bowl, either by stopping the bowl and draining the liquid out via gravity, using a centripetal pump or a skimming tube while the bowl rotates, or any other appropriate method.

A final mode of the separation cycle is usually a discharge mode, wherein the bowl is rotated at a low speed. A scraper, which is usually already located within the bowl is moved into a scraping position where the blades of the scraper are advanced into the compacted solids. Often the prior art scraper blades are attached to a support shaft in a planar arrangement, one above another. The scraping action forces the solids from the wall surface of the bowl, allowing them to drop through the bowl to an outlet. The prior art scraping systems generally work well for solids which are powdery, or otherwise hard and dry, but do not work effectively for solids which are wet and sticky and often have the consistency of peanut butter. Such sticky solids have a tendency to cling to the scraper blade and, further, to separate from the wall of the bowl and immediately reattach to a portion of the scraping assembly, often a lower positioned blade of the support shaft. Once the sticky solids reattach to the scraper blades of the prior art separators, the solids are difficult to recover.

Since the solid component of the stock mixture is commonly the desired component for further experimentation and/or analysis, any such solid component material remaining in the otherwise inaccessible internal separating structure of the separator after the separation cycle is complete is considered a valuable loss. The subsequent cleaning and sterilization steps of the cycle will immediately contaminate and otherwise destroy the uncollected solids rendering them unusable. Furthermore, not only is it desirable to collect all of the separated solids from the internal separating structure of the separator, any remaining solids not removed will place an undue burden on the cleaning systems of the separator. Any of the solids remaining after the completion of the cleaning cycle will result in an immediate contamination of subsequently added stock material, resulting in a greater loss of separated solids and possibly inaccurate data should such impure solids be later used in experimentation.

It is therefore an object of the invention to provide a centrifugal separator which overcomes the deficiencies of the prior art.

It is another object of this invention to provide a blade assembly for a separator which overcomes the tendency of the sticky material to cling or adhere to the blade.

It is another object of the invention to provide such a centrifugal separator which includes a scraper assembly which effectively removes a greater amount of solids than that removed by the prior art scraper separators.

It is another object of the invention to provide a scraper assembly for use with centrifugal separators which minimizes scraping drag while removing solids from the wall of the bowl and maximizes the amount of scraped solid material directed to the discharge outlet of the separator.

It is yet another object of the invention to provide a scraper assembly for use with centrifugal separators which includes a washing assembly that effectively cleans any remaining solids from the scraper, in accordance with the invention,

SUMMARY OF THE INVENTION

A scraper assembly for removing the collected solids component of a feed material from an interior wall surface of a centrifugal separator bowl comprises a supporting shaft positioned within the bowl along a vertically disposed longitudinal axis. The supporting shaft is pivotal between a stowed position and an operational position. At least two longitudinally spaced scraper blades are attached to the supporting shaft along the longitudinal axis and are adapted to contact the solids component when the support shaft is in the operational position. An upper scraper blade is angularly offset with respect to the lower scraper blade along the longitudinal axis so that any collected solids component removed by the upper scraper blade may freely drop clear of the lower scraper blade.

BRIEF DESCRIPTION OF THE DRAWINGS

To fully understand the invention, reference is made to the following description taken in connection with the accompanying drawings, in which:

FIG. 2 is a sectional view of the separator, taken along the lines 2—2 of FIG. 1, showing the scraper assembly with the scraper located in a rest position, in accordance with the present invention;

FIG. 3 is a sectional view of the separator similar to the view of FIG. 2, showing the scraper assembly with the scraper located in an operative position, in accordance with the invention;

DETAILED DESCRIPTION OF THE PREFERRED EMBODIMENT

Figure 1:
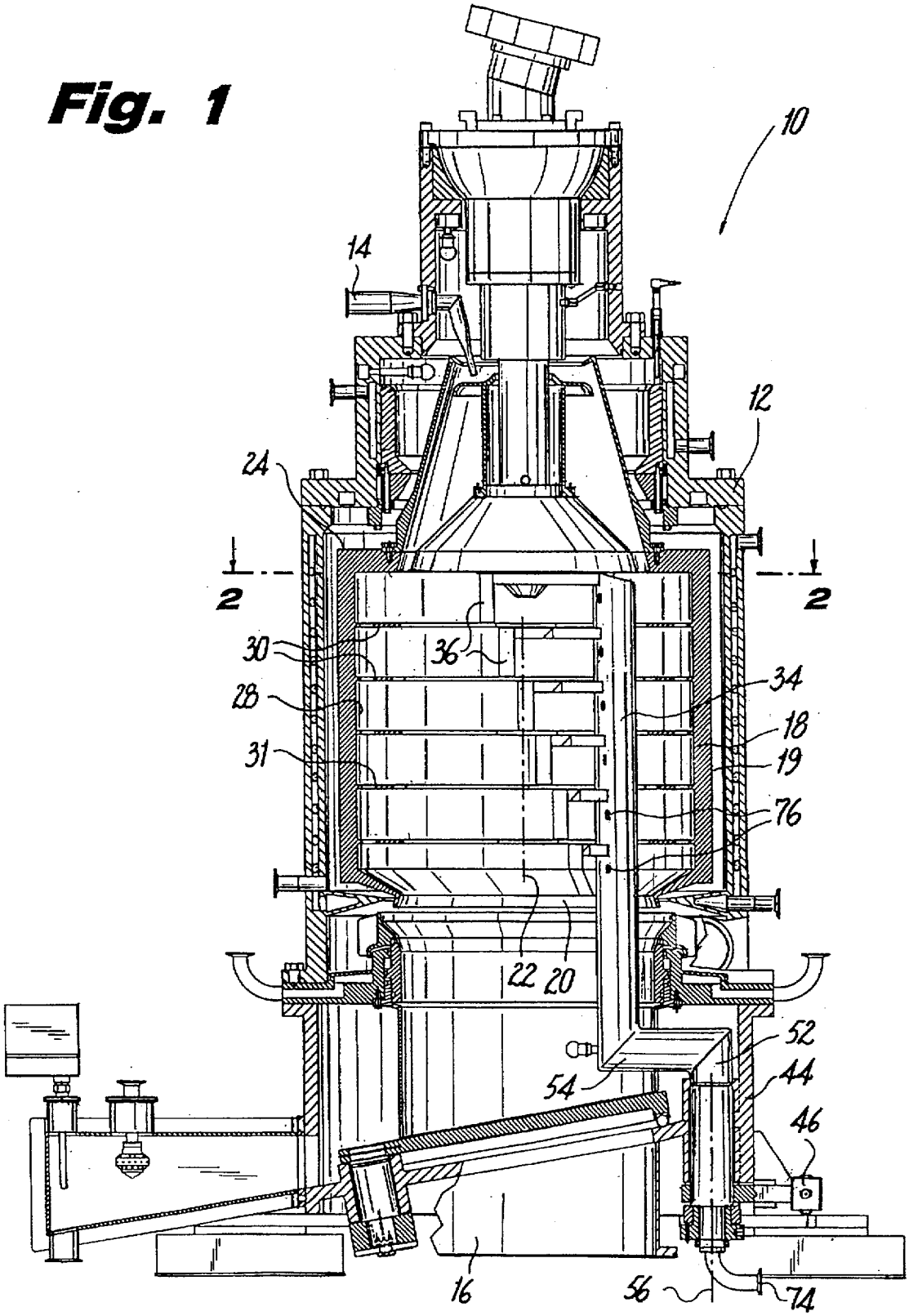
FIG. 1 is a sectional side view of a centrifugal separator having a scraper assembly, in accordance with the invention.

Referring to FIG. 1, a centrifugal separator 10 is shown in section, having a housing 12, an inlet 14, an outlet 16, and a cylindrical bowl 18 having an open lower end 20. The bowl 18 is positioned within a chamber 19 of the housing 12 and is rotatable about a vertically disposed central axis 22. The bowl 18 includes an upper end 24 which is connected to a drive shaft 26 and a motor (not shown). As appreciated by those skilled in the art, the bowl 18 and the drive shaft 26 may include, as necessary all the appropriate bearings and seals to provide sufficient support to the bowl 18 as it rotates at a high rate and separates the subject material located within the bowl, while maintaining an isolated environment within the bowl.

Figure 4:
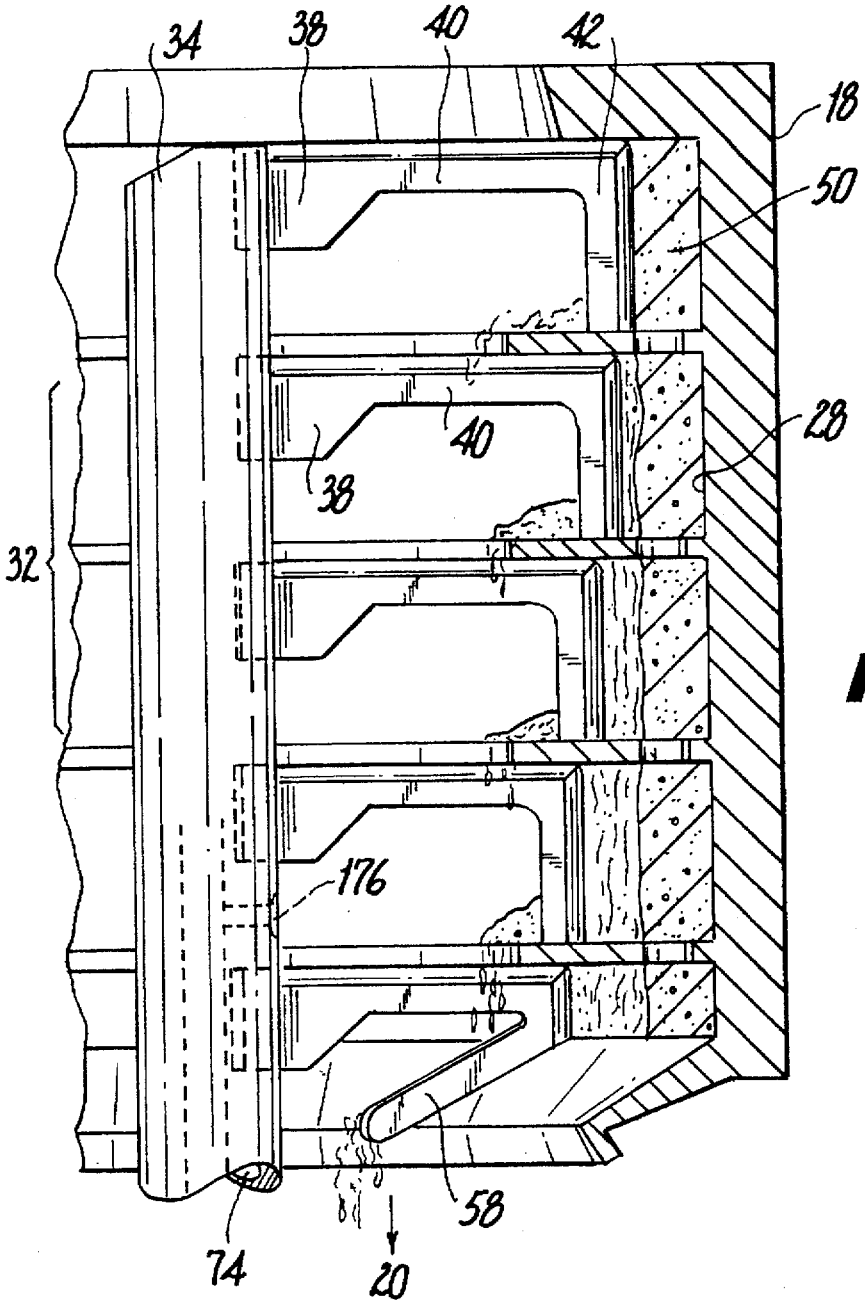
FIG. 4 is a sectional view of the separator, taken along the lines 4—4 of FIG. 3, showing the scraper operatively scraping solids from the wall of the separator bowl and between baffles.

The bowl 18 further includes an inner wall surface 28. As shown in FIGS. 1 and 4, attached to the wall surface 28 are five baffles 30. The use of such baffles 30 is well known and conventional. The baffles 30 improve separation performance but are not required to carry out the immediate invention.

Positioned within the bowl 18 is a scraper assembly 32 which includes a pivot shaft 52, a connection link 54, a scraper support shaft 34 and several scrapers 36 (five scrapers are shown in the Figures). Each scraper 36 includes a mounting end 38, a connecting arm 40 and a cutting blade 42. The pivot shaft 52 of the scraper assembly 32 is pivotally attached to the housing 12 through a bushing (or an appropriate bearing) 44 and is pivotal about a pivot axis 56. The support shaft 34 is connected to the pivot shaft 52 by the connection link 54 so that any angular displacement of the pivot shaft 52 will result in an arcuate displacement of the support shaft 34 whose radius of arc is equal to the length of the connection link 54 (i.e., the connection link defines a radius located between the central point which is the pivot axis 56, and a point along the circle, prescribed by the resulting pivotal movement). The support shaft 34 extends into the bowl 18 through the open lower end 20 and is pivotal within the bowl 18 between a rest position, as shown in FIG. 2, and an operational position, as shown in FIG. 3. Regardless of the position within the bowl 18, the support shaft 34 remains parallel to the central axis 22. The pivot shaft 52 is angularly displaced or pivoted, as necessary about the pivot axis 56, as described below, by an actuator 46, so that the support shaft 34 located within the bowl 18 may be moved along a arcuate path between the rest position and the operational position. It is preferred that the arcuate path followed by the support shaft 34 is close to the wall surface 28 and located behind the scrapers 36 (described below) so that during the scraping procedure, the support shaft 34 located in the operational position is "up stream" of the scraped solids, and therefore, will be clear of any falling solids, as shown in FIG. 3.

Figure 5:
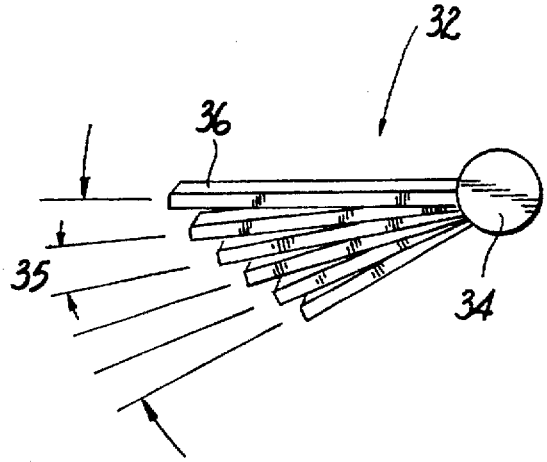
FIG. 5 is a illustrative top view of the scraper assembly showing a staggered scraper arrangement and a support shaft, in accordance with the invention.
Figure 6:
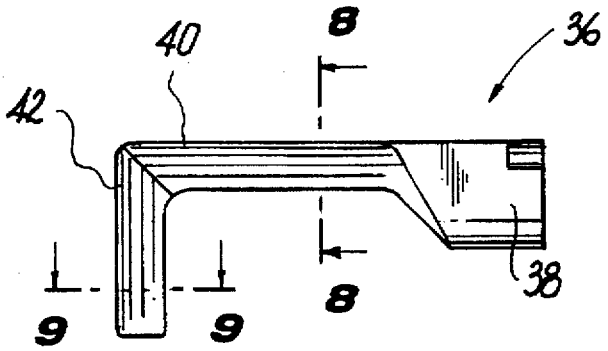
FIG. 6 is a side view of a scraper, in accordance with the invention.
Figure 7:
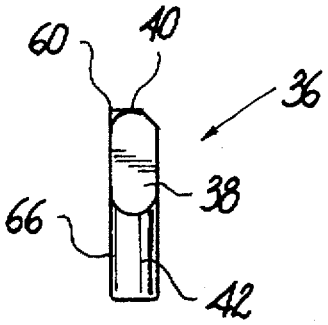
FIG. 7 is an end view of the scraper of FIG. 6.

In accordance with the invention, and as shown in FIGS. 1, 4, and 5, each scraper 36 is mounted to the support shaft 34 in a staggered arrangement, following a gradual spiral (similar to the stairs of a spiral staircase) so that each scraper 36 is angularly displaced by a predetermined angle 35 (see FIG. 5). Any conventional mounting method, such as welding, may be used to connect each mounting end 38 of each scraper 36 to the support shaft 34 in the desired spiral arrangement. The scrapers 36 are mounted to the support shaft 34 so that the respective connecting arms 40 of each scraper 36 extend radially outward (perpendicular to the support shaft 34) from the support shaft 34 and are angularly displaced to establish the desired spiral arrangement. The cutting blade 42 of each scraper 36 is attached to the most radially outward end of each respective connecting arm 40 and is preferably directed perpendicularly downward by and parallel to the central axis 22. The length and shape of each cutting blade 42 is adapted to conform to the specific contours of the wall surface 28 of the bowl 18 within its immediate area when the scrapers are located in the operational position, closest to the wall surface 28.

Collectively, all of the cutting blades 42 are sized and shaped to effectively conform to the shape of the bowl 18, when the support shaft 34 is located in the operative position. If baffles 30 are used within the bowl 18, the length of each cutting blade 42 is preferably equal to approximately the distance between two adjacent baffles 30 so that each cutting blade 42 may fit between two adjacent baffles 30 and operationally reach the wall surface 28 of the bowl 18 located between the two adjacent baffles 30. It is important that the scrapers 36 reach a maximum surface area of the wall surface 28, including at least the upper surfaces 31 of each baffle 30 so that the mount of useful pure solids discharged from the bowl 18 is also maximized.

Referring to FIGS. 2 and 3, a sectional top view of the bowl 18, in accordance with the invention reveals the preferred staggered arrangement of the scrapers 36 (angularly displaced about the support shaft 34). The purpose of the staggered scrapers 36 is to offset each connecting arm 40 so that any scraped solid will fall clear of any connecting arms 40 located below and therefore will be free to fall through the bowl 18, through the open lower end 20 and expelled from the separator 10.

The support shaft 34 is shown in a rest position in FIG. 2, located remote from any baffle 30 or the wall surface 28 of the bowl 18 so that the bowl 18 may freely rotate and separate the contained stock material. However, during the scraping procedure, the actuator 46 is activated to move the support shaft 34 from the rest position towards the operative position, in the direction as shown by the arrow 48 in FIG. 2. The actuator 46 introduces a predetermined magnitude of torque to the support shaft 34 directed towards the operative position so that each cutting blade 42 of each staggered scraper 36 slowly and evenly moves radially outwardly, with respect to the central axis 22, within the bowl 18 towards the wall surface 28, eventually contacting and scraping away the most radially inward surface of the compacted solids 50. Each scraper 36 will continue to scrap away the compacted solids 50 located within the respective reach of each cutting blade 42 until the support shaft 34 reaches a predetermined limit of travel within the operational position, which preferably leaves the cutting blade 42 of each scraper 36 immediately adjacent to the wall surface 28, yet not in physical contact with the wall surface 28.

As shown in FIG. 4, as the solid material is scraped from the wall surface 28 of the bowl 18, the solids 50 fall from an adjacent baffle 30 and through the lower open end 20. The staggered arrangement of each scraper 36 with respect to each other, as shown in FIG. 5, prevents contact between any of the connecting arms 40 or the cutting blades 42 with the released and falling solids 50. The relative position of the cutting blades 42 and the support shaft 34, with respect to each other and with respect to the central axis 22, further discourages contact between any scraped solids and any part of the scraper assembly 32. As shown in FIGS. 2 and 5, the length of each connecting arm 40 is such that, collectively, the cutting blades 42 of all the scrapers 36 follow a curvature similar to the curvature of the bowl 18.

The particular "angle of attack" of each scraper 36, defined as the angle between the connecting arm 40 and the connection link 54, is predetermined and preferably fixed. However, Applicant contemplates providing a variable angle of attack, changing as the support shaft 34 moves between the rest and the operative position so that the cutting blades 36 of the scrapers always follow the curvature of the wall surface 28 regardless of their distance therefrom. A fixed version is preferred for reasons of simplicity and ease of cleaning.

Referring to FIG. 4, a scraping procedure is shown wherein all of the scrapers 36 are removing solids 50 from the wall surface 28 and from the baffles 30. The staggered arrangement of the scrapers 36 allows any removed solids 50 to freely fall through the bowl 18 without reattaching to any other scraper 36 or the support shaft 34. The uppermost scraper and the lowermost scraper 36 may include cutting edges formed integrally along their respective connection arm 40 or as a cutter extension 58 to better conform to the shape of the bowl 18 and ensure that a maximum surface area of the bowl 18 is reached prior to a cleaning procedure.

Figure 8:
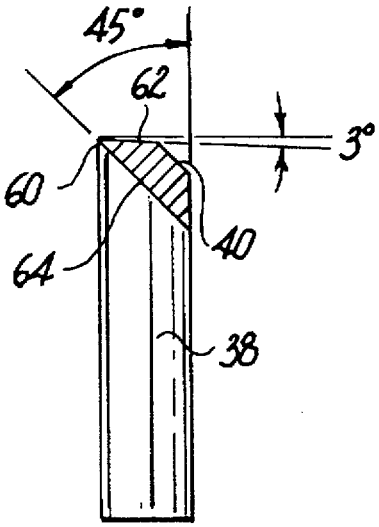
FIG. 8 is a sectional view of the scraper, taken along the lines 8—8 of FIG. 6.

Referring to FIGS. 6 through 9, details of the scraper 36, in accordance with the invention are shown. The preferred scraper 36 includes a connecting arm 40 having a somewhat truncated triangular cross-section, as shown in FIG. 8, with a cutting edge 60 which is preferably 45 arc degrees from horizontal reference line and an upper surface 62 which is about 3 arc degrees from the horizontal reference line, as shown. The connecting arm 40 includes a deflecting surface 64 which immediately follows (up stream) the cutting edge 60 and deflects the scraped solids downwardly towards the open lower end 20 of the bowl 18. The cutting edge 60 located on the connecting arm 40 discourages any falling solid which happens to contact the connecting arm 40 from adhering to the connecting arm 40.

Figure 9:
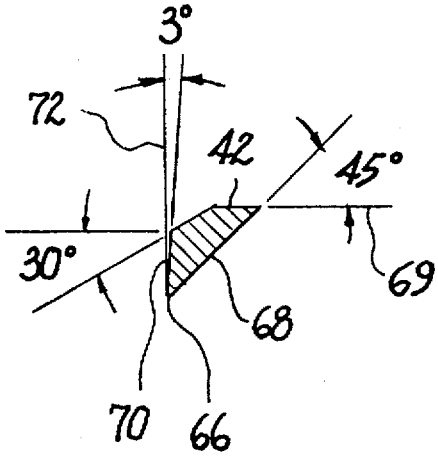
FIG. 9 is a sectional view of the scraper, taken along the lines 9—9 of FIG. 6.

Similar to the connecting arm 40, the cutting blade 42 of each scraper 36 also preferably includes a somewhat truncated triangular cross-section, as shown in FIG. 9 including a cutting edge 66 which is defined by the intersection of a 45 arc degree deflecting surface 68, as measured from the horizontal (reference line 69 in FIG. 9), and an opposing surface 70 which is 3 arc degrees, as measured from the vertical (reference line 72 in FIG. 9). The cutting edge 66 of each cutting blade 42 is designed to efficiently cut through the solids material 50, pulling it from the wall surface 28, and then deflecting the removed solids inwardly towards the central axis 22 of the bowl 18, as shown in FIG. 3, thereby keeping any free solid away from any lower scraper 36 or the support shaft 34.

In another embodiment of the invention, a fluid conduit 74 is located within the pivot shaft 52, the connection link 54 and the support shaft 34. The support shaft 34 further includes nozzles 76, one being located just below, and coplaner with, each scraper 36. A cleaning fluid, such as water, located at a remote fluid source (not shown) is forced through the fluid conduit 74 and the nozzles 76, at a prescribed fluid pressure, to provide a fluid stream or spray directly to the connecting arm 40 and the cutting blade 42 of each scraper 36. The direct fluid application forces any residual solids remaining on the surfaces of the scrapers 36 to fall freely from the bowl 18, during the otherwise conventional cleaning procedure.

In operation, during a feed mode, a sample amount of a subject stock material is introduced through the inlet 14 and into the bowl 18. The bowl 18 is concurrently rotating at a prescribed rate of rotation which is sufficient to retain the entering subject material within the bowl 18 against the influence of gravity. The lower end of the bowl is open throughout the separating procedure, but a collection container located below the bowl for collecting solids is closed off using a solids gate. Once the predetermined amount of subject material is introduced, the speed of the bowl 18 increases to a separation speed which is sufficient to produce up to 20,000 G's of force (resolutions per minute). As the bowl rotates, the subject material is generally separated into solids, which pack tightly against the wall surface 28, and a clarified liquid which is continuously spun out of the bottom of the bowl and directed into a centrate tank. The consistency of these solids depends on the operating speed of the bowl 18, the initial subject material being separated, and the amount of liquids remaining against the solids. For most biological and other applications, it is not uncommon for the solids to have a sticky consistency, similar to that of peanut butter.

After separation, during a drain mode, the rotation of the bowl 18 is slowly reduced and stopped (to avoid disturbing the compacted solids). Once stopped, the residual liquid is drained freely from the bowl and directed, in part by the closed solids gate, into a residual tank.

Once the residual liquid is drained from the bowl, the solids may be removed during a discharge mode. The bowl 18 is rotated at low speed and the solids gate is opened to allow any falling solids to enter into the solids collection container (not shown). The actuator 46 is activated which rotates the pivot shaft 52 causing the connection link 54, the shaft support 34, and all the attached scrapers 36 to move along the prescribed arc within the bowl 18, from the rest position shown in FIG. 2 to the operational position shown in FIG. 3. The actuator 46 continues to exert a predetermined amount of torque to the pivot shaft 52, which evenly forces the scrapers 36 into overlapping contact with the compacted solids 50 lying against the wall surface 28. As the solids move relative to the scrapers 36, the cutting edges 66 and the deflecting surfaces 68 of each scraper 36 forces a predetermined amount of solids 50 from the wall surface 28 and the adjacent baffles 30 towards the central axis 22. Since the support shaft 34 is located "up stream" of the point of cutting and away from the central axis 22, and each scraper 36 is staggered progressively "up stream" from top to bottom, as shown in FIGS. 1, 2, 3 and 5, the solids 50 will freely fall through the cylindrical bowl 18 following the central axis 22 through the open lower end 20, and will avoid any contact with any portion of any scraper 36 and/or the support shaft 34.

As the bowl 18 rotates at the scraping speed, the support shaft 34 and collectively all of the scrapers 36 move along the arcuate path (indicated by the arrow in FIG. 2) until the cutting edges 60 reach the predetermined stop point which is located as close as possible to the wall surface 28 of the bowl 18 without physical contact. Movement of the support shaft 34 between the rest position and the operational position may then be repeated to maximize the removal of any residual solids from the surrounding surfaces. In another embodiment of the invention, the support shaft 34 may be driven back and forth (i.e., reciprocated) along the arcuate path at a high oscillation rate (between 2,000 and 50,000 cycles per minute) and ideally, at the resonant frequency of the scraper assembly 32. The resulting vibration of the entire scraper assembly 32 will ensure more of the valuable solids to fall from the scrapers 36 and the shaft support 34.

Once all of the solids 50 are effectively removed from the separator 10, the cleaning system is activated, as described above, and a cleaning fluid is forced into the fluid conduit 74 and out nozzles 76 to effective by clean all remaining solids from the separator 10.

Other embodiments will occur to those skilled in the art and are within the scope of the following claims:

What is claimed is:

1. A centrifugal separator system for separating the solids component of a feed material at a high speed, comprising:

a bowl having an interior wall surface and being rotatable about a vertically disposed longitudinal axis, said bowl being adapted to receive said feed material, said interior wall surface being adapted to collect said separated solids component; and a support shaft having a longitudinal axis, said support shaft supporting at least two longitudinally spaced scraper blades, said scraper blades being adapted to contact and remove said collected solids component of said feed material from said interior wall surface so that said solids component may freely drop longitudinally through said bowl and into a collection area;

said support shaft being pivotable about an axis laterally spaced from said longitudinal axis of said support shaft between a stowed position wherein said scraper blades are positioned remote from said interior wall and an operational position wherein said scraper blades are in contact with said collected solids component located against said wall surface;

said scraper blades being angularly offset with respect to each other so any of said solids component removed by an upper blade of at least two of said blades may freely drop along said longitudinal axis without interference with a lower of said two blades.

2. A scraper assembly for removing the collected solids component of a feed material from an interior wall surface of a centrifugal separator bowl, said scraper assembly comprising:

a supporting shaft having a longitudinal axis, said supporting shaft positioned within said bowl along a vertically disposed longitudinal axis, said supporting shaft being pivotal about an axis laterally spaced from said longitudinal axis of said supporting shaft between a stowed position and an operational position;

at least two longitudinally spaced scraper blades attached to said supporting shaft along said longitudinal axis, and adapted to contact said solids component when said support shaft is in said operational position, said at least two longitudinally spaced scraper blades including an upper scraper blade and a lower scraper blade, said upper scraper blade being angularly offset with respect to said lower scraper blade along said longitudinal axis so that any collected solids component removed by said upper scraper blade may freely drop clear of said lower scraper blade.

* * * * *